United States Patent [19]

Levin et al.

[11] Patent Number: 4,854,212

[45] Date of Patent: Aug. 8, 1989

[54] BOWING GUIDE FOR STRINGED INSTRUMENT

[76] Inventors: Zaida Levin, P.O. Box 242; Keith Hovis, P.O. Box 216, both of Croton Falls, N.Y. 10519

[21] Appl. No.: 191,076

[22] Filed: May 6, 1988

[51] Int. Cl.[4] ..... G10D 1/02

[52] U.S. Cl. ..... 84/283

[58] Field of Search ..... 84/283, 453, 465

[56] References Cited

U.S. PATENT DOCUMENTS

| | | | |
|---|---|---|---|
| 766,549 | 8/1904 | Strauss et al. | 84/283 |
| 1,192,030 | 7/1916 | Ashley | 84/283 |
| 1,788,700 | 1/1931 | Battams | 84/283 |
| 2,782,670 | 2/1957 | Lipski | 84/283 |
| 3,107,568 | 10/1963 | La Porte | 84/283 |
| 3,306,150 | 2/1967 | Phillips | 84/283 |
| 4,222,302 | 9/1980 | Sanfilippo | 84/283 |

FOREIGN PATENT DOCUMENTS

| | | | |
|---|---|---|---|
| 3100676 | 4/1982 | Fed. Rep. of Germany | 84/283 |
| 28771 | 8/1932 | Netherlands | 84/283 |
| 135769 | 10/1929 | Switzerland | 84/283 |

*Primary Examiner*—L. T. Hix
*Assistant Examiner*—Brian W. Brown
*Attorney, Agent, or Firm*—Barry G. Magidoff

[57] ABSTRACT

This invention provides a practice training attachment for stringed instruments, to assist in the training of neophyte players or for the continued practice of advanced players, with respect to the correct positioning of the bow when playing the instrument by drawing the bow across the strings; the guide comprises base means, clamping means for securing the base means to the fingerboard of a stringed instrument, and preferably two guide members removably secured to the base means and designed to be positioned at and to extend from, a location above the base means a sufficient distance to avoid contact with the strings of the instrument. Preferably the guide means are formed of a rigid transparent material.

7 Claims, 2 Drawing Sheets

BOWING GUIDE FOR STRINGED INSTRUMENT

BRIEF DESCRIPTION OF THE INVENTION

The present invention relates to a bowing guide for a stringed musical instrument such as a violin or violoncello, or viola. The bow guide is of the type which can be secured to the fingerboard without obstructing playing of the strings.

BACKGROUND OF THE INVENTION

A major problem in training new students of the violin or viola, or other bowed instruments, is avoiding poor habits with regard to the drawing of the bow. Specifically, in order to obtain a clear and proper tone from the instrument and to achieve maximum efficiency of bowing, it is important to draw the bow along a line substantially perpendicular to the strings at an optimum distance from the bridge, utilizing a properly relaxed arm and wrist movement. Maintaining the bow in the correct perpendicular movement is often quite difficult for the students, and even an experienced performer may lapse from the correct technique.

This problem has been recognized in the past, and many attachments for violins and the like have been previously described. Many of these devices have also been secured to the fingerboard, but utilize wire-type guide members permanently secured to the clamp means. See, for example, U.S. Pat. Nos. 766,549, 1,192,030, 2,782,670 and 3,306,150, as well as German Patent No. DE3,100,676, applied for Jan. 12, 1981 and issued Apr. 15, 1982, British Patent No. 19,694 of 1889 and Netherlands Patent No. 28,771 of 1932. In addition, removably secured devices utilizing a pair of secured flat plates in spaced relationship to permit the passage of a bow therebetween, is described in Swiss Patent No. 135,769 of Dec. 16, 1929, and another removable flat guide showing a single guide member is described in U.S. Pat. No. 3,107,568. In addition, it has been suggested to secure the bow guide to the so-called "F holes" through the body of the violin, such as in U.S. Pat. No. 4,222,302.

It is an object of the present invention to provide a bow guide for a stringed instrument wherein the major structure of the guide can be substantially permanently or semi-permanently affixed to the instrument's fingerboard, but wherein the guide surfaces can be readily removable. It is a further object of the present invention to provide a bow guide that is substantially inconspicuous, so as to avoid distracting the player who may look at the instrument while playing, as well as for aesthetic reasons, the base of which appears to be an extension, or part, of the fingerboard.

GENERAL DESCRIPTION OF THE INVENTION

A practice training attachment, for stringed instruments which are played by bowing, is provided to assist in the training of neophyte players or for the continued coaching of advanced players. The guide comprises, in combination, base means, clamping means for securing the base means to the fingerboard of the stringed instrument, a plurality of guide members designed to be removably secured to the base means, and a plurality of slotted holding means for removably retaining the guide members, the guide members preferably having substantially planar guide surfaces and being provided with an arching cutout portion such that the transverse, arched edge of each guide surface closest to the base is located above the strings of the instrument. Most preferably, the guide members are flat, transparent plates, which have a surface extending in a plane perpendicular to the axes of the strings.

DETAILED DESCRIPTION OF THE INVENTION

Figure 1:
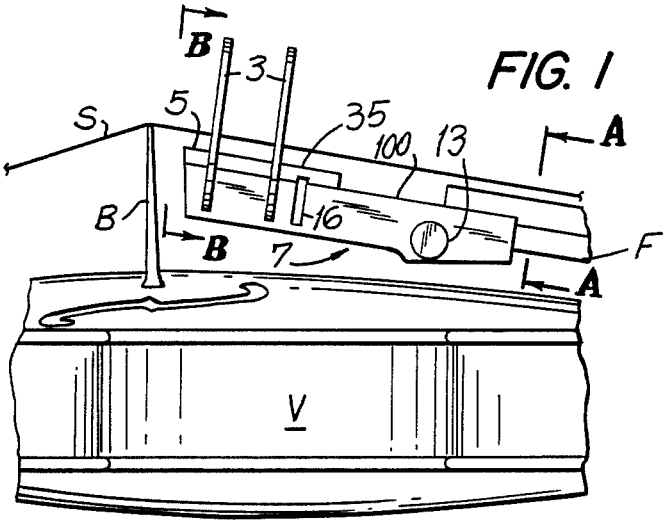
FIG. 1 is a partial side elevation view of a violin showing the bow guide of the present invention in place.
Figure 2:
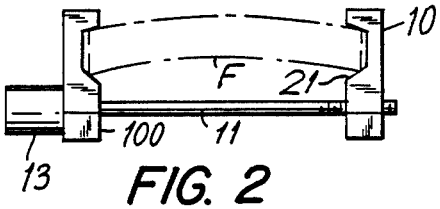
FIG. 2 is a cross-section view showing the fingerboard clamped place and taken along lines A—A of FIG. 1.
Figure 3:
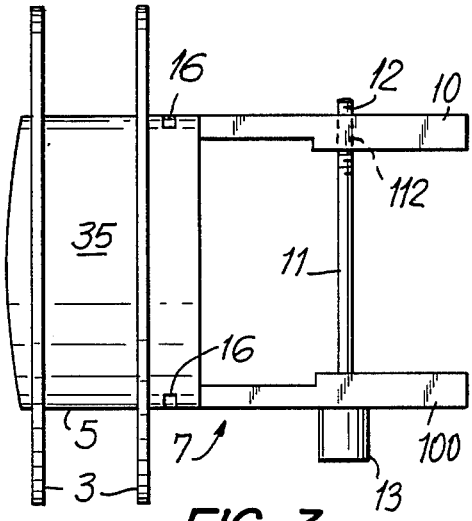
FIG. 3 is a top plan view of the bow guide of the present
Figure 4:
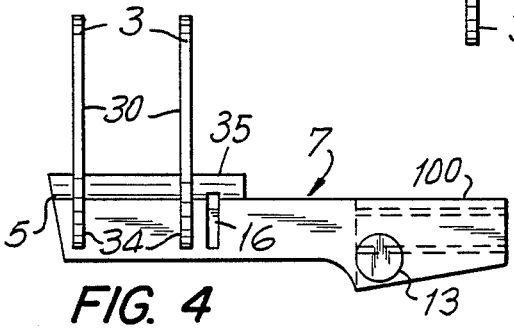
FIG. 4 is a side elevation view of the bow guide of the present
Figure 5:
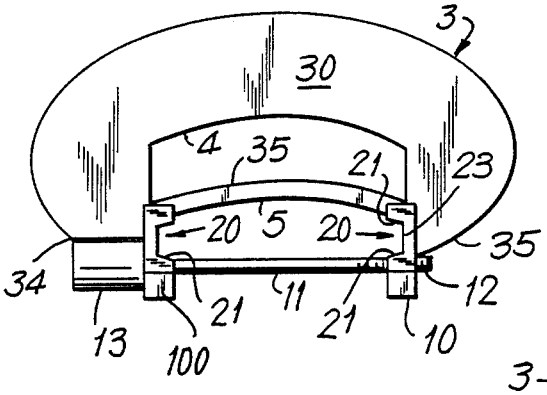
FIG. 5 is an end view of the bow guide of the present invention, in the same direction as in FIG. 2.
Figure 6:
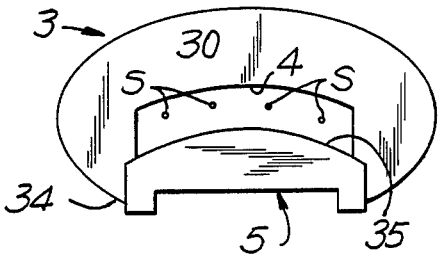
FIG. 6 is an end cross-section taken along lines B—B of FIG. 1.
Figure 7:
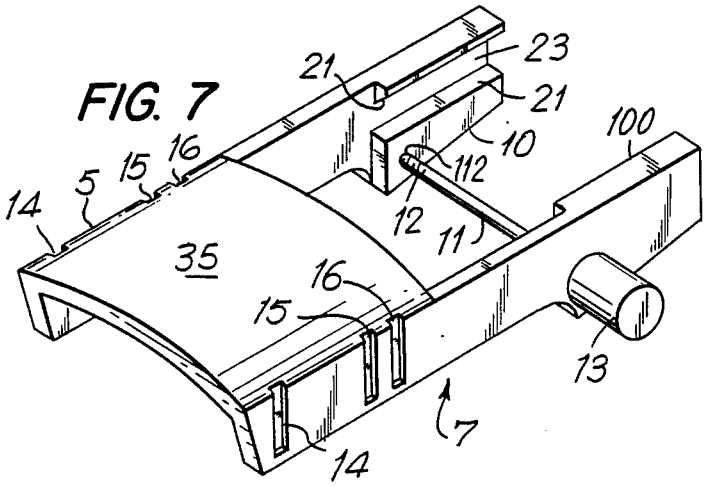
FIG. 7 is an isometric view showing the base of the bow guide of the present invention, with the guides removed.
Figure 8:
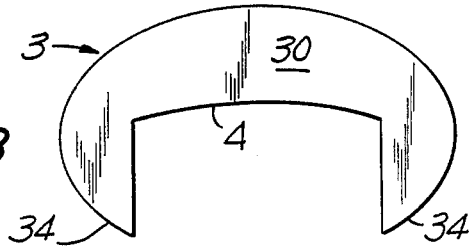
FIG. 8 is a front elevational view of one of the guides.

Referring to FIG. 1, the bow guide is shown in place on a violin including the violin body V, the string bridge B and fingerboard F and strings S. The base, generally indicated by the numeral 7, of the bow guide is clamped to the fingerboard F by clamp arms 10, 100. The fingerboard F is held in the clamp grooves 20, formed in the facing surfaces of the clamp arms 10, 100, which as shown in FIGS. 2 and 5 have convergent lateral surfaces 21 converging inwardly into the groove. This permits the clamp to securely hold fingerboards of different thicknesses when the clamp is tightened. The inner surface 23 can be planar, as shown, can converge to an apex (sharp or rounded), or the two lateral surfaces 21 can extend the full thickness of the clamp arms 10, 100, (i.e., removing the inner surface 23, thus splitting the two clamp arms 10, 100, longitudinally), if the material of the arms is of sufficient strength and rigidity.

The clamp arms 10, 100 are pressed together by turning the clamp thumb screw 11, having an enlarged thumb turning end 13 extending outwardly from one clamp arm 100, a shaft 11 extending through the arm 100, and a threaded end 112; a threaded opening 112 extends through the second clamp arm 10, designed to be threadedly secured to the threaded end 12 of the clamp screw 11. Rotating the clamp screw 11 presses together or separates the clamp arms 10, 100. Extending between the clamp arms 10, 100 at the forward ends thereof, is a base platform 5 having an arching convex upper surface 35. Three pairs of concave slots 14, 15, 16 extend inwardly into the outside surface of each clamp arm 10 and into the arching top platform 5.

A pair of guide plates 3, preferably made of a relatively rigid transparent polymeric material, such as polyethylene, polyvinylchloride, polycarbonate, or Plexiglas, are formed in the general shape of a "C". The concave surface 4 of each guide plate 3 is sufficiently distanced from the ends of the guide arms 34, as to rest above the strings S when the guide 3 is held in the slots 14, 15, 16. The thicknesses of the guide arms 34 is so dimensioned as to provide a friction fit into the slots 14, 15 and 16 and the surface 4 extends wholly across the arched guide platform 35 and over the strings S. Generally, one of the guide plates 3 is inserted into the outer slots 14 and the second guide plate 3 is inserted into one or the other of the inner slots 15, 16, depending upon the expertise or the preference of the player drawing the bow. At least one main surface 30 of each guide piece is substantially planar over a substantial portion.

The bow guide can be secured to the violin, with the guide plates 3 removed, by loosening the clamp screw 11 and sliding the guide base 7 under the strings such that the front end of the fingerboard F slides between the clamp arms 10, 100 into the clamp grooves 20. The thumb screw 13 is turned causing the arms 10, 100 to be drawn together as the threaded end 12 moves more deeply into the threaded opening 112, until the arms 10, 100 are clamped tightly around the fingerboard F. The extent to which the screw 11 is turned to draw the clamp arms 10, 100 together is a function of the thickness of the fingerboard F and thus the distance into the clamp grooves 20 that the fingerboard F extends; specifically, a thinner fingerboard will extend more deeply into the grooves 20 until the corner edges touch the converging surfaces 21, thus requiring the arms 10, 100 to be drawn closer together by screw thread 12. A thicker fingerboard F will not be able to extend as deeply into the grooves 20 thereby leaving the arms 10, 100 more widely separated when the base 7 is secured in place.

The guide members 3 are then placed over the strings S such that the arms 34 of the first guide extend into slots 14 and the arms of the second guide extend into one of the other pairs of slots 15, 16. The width of the slots 14, 15, 16 and the thickness of the guide arms 34 are such that when mated they form a tight slip fit, such that the guide members 3 are firmly held in place by friction.

It is preferred that the arch of the convex platform surface 35 be substantially similar to the curve of the top surface of the keyboard F so as to maintain the appearance of the violin instrument. In this manner, the clamp base can be maintained permanently affixed to the instrument without significantly changing its appearance or interfering with the musical tone of the instrument. As shown, the fingerboard is elevated above the resonating body of the instrument and thus the clamp on the fingerboard does not affect the tone of the instrument.

The distal end of the guide members 3 can be angled outwardly, away from the opposing guide surface, to provide a funneling effect for inserting the bow between the guide surfaces 30.

The base 7 is preferably formed of a dark material, preferably having the same appearance as the fingerboard, and includes being formed of wood or being molded of a dark opaque polymeric plastic material such as ABS plastics, cellulosics, polypropylene, polyethylene, nylons, and polyurethanes, which may be reinforced in a known manner.

The guides 3 can be readily removed and not used when, for example, performing in concert, or, for more advanced players, only a single guide can be used during practice sessions.

The design of the guide plates 3 is critical only to the extent that the internal cutout surfaces 4 are cut sufficiently far back from the arms 34 extending into the slots 14, 15, 16, that there is sufficient clearance for the strings to pass unhindered, and the thickness of the guide arms 34 is such as to fit into, but be firmly held by, the base slots 14, 15, 16. The fit is considered to be sufficiently tight such that when the instrument is inverted the guides 3 are not dislodged by their own weight.

The patentable embodiments of this invention which are claimed are as follows:

1. A bow guide means for a stringed instrument having a resonating body, a fingerboard, strings and a bridge for supporting the strings above the fingerboard, the bridge being separated from the proximal end of the fingerboard, so as to define a gap between the bridge and the fingerboard, the bow guide means comprising a base and at least one guide piece removably secured to the base; the base comprising an elongated guide platform adapted to extend longitudinally along the gap between the fingerboard and the bridge and positioned intermediate the strings and the resonating body, a pair of clamp arms extending longitudinally outwardly from the guide platform and adapted to engage the sides of the fingerboard at a location adjacent the proximal end of the fingerboard, tightening means adapted to cause the arms to be clamped to the sides of the fingerboard for supporting the guide platform therefrom, and guide piece securing surfaces on the base; the guide piece comprising a substantially planar transparent guide surface member, guide supporting means adapted to support the guide surface member above the strings and base receiving surfaces on the guide supporting means, removably mating with the guide piece securing surfaces, for supporting the guide piece on the base, so that the guide piece extends laterally outwardly from the guide platform, the guide supporting means being of sufficient length such that the guide surface will extend, above and across the strings when the base is clamped to the fingerboard, and the base being adapted to be located wholly between the strings and the resonating body when secured to the fingerboard.

2. The bow guide of claim 1 comprising a second guide piece removably secured to the base and longitudinally separated from the first guide piece by a distance greater than the width of a bow.

3. The bow guide of claim 1 wherein each guide piece is a unitary member formed of a substantially rigid transparent plate.

4. The bow guide of claim 1 wherein the tightening means comprises a threaded shaft member extending between the two arms and rotatably secured to one of the arms and threadedly secured to the second arm.

5. The bow guide of claim 1 wherein the guide securing surfaces comprise concave surfaces defining slots on opposing sides of the platform.

6. The bow guide of claim 1 wherein the pair of clamp arms provide opposing grooves for receiving opposite sides of a fingerboard, the grooves being located adjacent the ends of the clamp arms distant from the guide platform, the inwardly extending lateral surfaces of each groove being convergent.

7. A bow guide means for a stringed instrument having a resonating body, a fingerboard, strings and a bridge for supporting the strings above the fingerboard, the bridge being separated from the proximal end of the fingerboard, so as to define a gap between the bridge and the fingerboard, the bow guide means comprising a base and at least one guide piece removably secured to the base; the base comprising an elongated guide platform adapted to extend longitudinally along the gap between the fingerboard and the bridge and positioned intermediate the strings and the resonating body, a pair of clamp arms extending longitudinally outwardly from the guide platform and adapted to engage the sides of the fingerboard at a location adjacent the proximal end of the fingerboard, tightening means adapted to cause the arms to be clamped to the sides of the fingerboard for supporting the guide platform therefrom, and guide piece securing slots extending into the base and having an opening adapted to face outwardly towards the strings when the bow guide means is secured to a stringed instrument; the guide piece comprising two legs and a substantially planar guide surface member extending between the two legs, and base receiving surfaces on each leg, removably mating with the guide piece securing slots for supporting the guide piece on the base, the slots and receiving surfaces being mutually arranged that the guide piece extends laterally outwardly from the guide platform when supported by the guide platform, and that the guide piece can be removed from the platform by pulling the guide piece in the single direction laterally outwardly from the platform; the two legs being of sufficient length such that the guide surface extends above and across the strings when the base is clamped to the fingerboard, and the base being adapted to be located wholly between the strings and the resonating body when secured to the fingerboard.

* * * * *